US008193706B2

(12) United States Patent
Kim

(10) Patent No.: US 8,193,706 B2
(45) Date of Patent: Jun. 5, 2012

(54) PLASMA DISPLAY DEVICE AND MULTI PLASMA DISPLAY DEVICE

(75) Inventor: Hyunkuk Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 203 days.

(21) Appl. No.: 12/638,273

(22) Filed: Dec. 15, 2009

(65) Prior Publication Data

US 2011/0115364 A1 May 19, 2011

(30) Foreign Application Priority Data

Nov. 19, 2009 (KR) ..... 10-2009-0111963

(51) Int. Cl.
*H01J 17/49* (2006.01)

(52) U.S. Cl. ..... 313/581; 313/587

(58) Field of Classification Search ..... None
See application file for complete search history.

(56) References Cited

U.S. PATENT DOCUMENTS

2008/0018626 A1* 1/2008 Yang et al. ..... 345/204
2008/0101002 A1* 5/2008 Kim et al. ..... 361/681
2008/0106494 A1* 5/2008 Chung ..... 345/60

FOREIGN PATENT DOCUMENTS

EP 1 919 265 A2 5/2008
JP 11-288750 A 10/1999
JP 2004-086134 A 3/2004

OTHER PUBLICATIONS

European Search Report dated Aug. 19, 2010 issued in Application No. 09 01 5448.

* cited by examiner

*Primary Examiner* — Ashok Patel
(74) *Attorney, Agent, or Firm* — Ked & Associates LLP

(57) ABSTRACT

A plasma display device and a multi plasma display device are disclosed. The plasma display device includes a front substrate, a rear substrate opposite the front substrate, an electrode between the front substrate and the rear substrate, a seal layer between the front substrate and the rear substrate, a driving board positioned in the rear of the rear substrate, and a flexible circuit board electrically connecting the driving board to the electrode. The flexible circuit board is electrically connected to a side surface of the electrode.

18 Claims, 14 Drawing Sheets

PLASMA DISPLAY DEVICE AND MULTI PLASMA DISPLAY DEVICE

This application claims the benefit of Korean Patent Application No. 10-2009-0111963 filed on Nov. 19, 2009, the entire contents of which is incorporated herein by reference for all purposes as if fully set forth herein.

BACKGROUND OF THE INVENTION

1. Field of the Invention

Embodiments of the invention relate to a plasma display device and a multi plasma display device.

2. Discussion of the Related Art

A plasma display apparatus includes a plasma display panel. The plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display device comprising a front substrate, a rear substrate opposite the front substrate, an electrode between the front substrate and the rear substrate, a seal layer between the front substrate and the rear substrate, a driving board positioned in the rear of the rear substrate, and a flexible circuit board electrically connecting the driving board to the electrode, the flexible circuit board being electrically connected to a side surface of the electrode.

An adhesive layer including conductive particles may be positioned between the flexible circuit board and the side surface of the electrode. The adhesive layer may contact the front substrate, the rear substrate, and the seal layer.

In another aspect, there is a plasma display device comprising a front substrate, a rear substrate opposite the front substrate, an electrode between the front substrate and the rear substrate, a seal layer between the front substrate and the rear substrate, a driving board positioned in the rear of the rear substrate, and a flexible circuit board electrically connecting the driving board to the electrode, the flexible circuit board being electrically connected to a side surface of the rear substrate.

In another aspect, there is a plasma display device comprising a front substrate, a rear substrate opposite the front substrate, an electrode between the front substrate and the rear substrate, a seal layer between the front substrate and the rear substrate, a driving board positioned in the rear of the rear substrate, and a flexible circuit board electrically connecting the driving board to the electrode, wherein the flexible circuit board is attached to the adhesive layer, so that the flexible circuit board overlaps the front substrate, the rear substrate, and the seal layer using the adhesive layer.

The adhesive layer may include conductive particles.

A size of an overlapping portion between a side surface of the front substrate and the flexible circuit board may be less than a size of an overlapping portion between a side surface of the rear substrate and the flexible circuit board.

A side surface of the front substrate may include a first portion, in which the adhesive layer and the flexible circuit board are positioned, and a second portion, in which the adhesive layer is positioned and the flexible circuit board is not positioned. A size of the first portion may be greater than a size of the second portion.

The flexible circuit board may be electrically connected to a side surface of the electrode.

In another aspect, there is a plasma display device comprising a front substrate, a rear substrate opposite the front substrate, an electrode between the front substrate and the rear substrate, a seal layer between the front substrate and the rear substrate, a driving board positioned in the rear of the rear substrate, a flexible circuit board electrically connecting the driving board to the electrode, and an adhesive layer electrically connecting the electrode to the flexible circuit board, the adhesive layer contacting a front surface and a side surface of the front substrate and a side surface and a back surface of the rear substrate.

The adhesive layer may contact the seal layer. The adhesive layer may include conductive particles.

The adhesive layer may include a first portion contacting the front surface of the front substrate, a second portion contacting the back surface of the rear substrate, a third portion contacting the side surface of the front substrate, and a fourth portion contacting the side surface of the rear substrate. A width of the second portion may be greater than a width of the first portion. A width of the third portion and a width of the fourth portion may be greater than the width of the first portion.

The flexible circuit board may be attached to the second portion and is not attached to the first portion.

In another aspect, there is a multi plasma display device comprising a first panel, a second panel positioned adjacent to the first panel, and first and second flexible circuit boards positioned in a boundary portion between the first panel and the second panel, wherein the first panel includes a front substrate, a rear substrate opposite the front substrate, an electrode between the front substrate and the rear substrate, and a seal layer between the front substrate and the rear substrate, wherein the second panel includes a front substrate, a rear substrate opposite the front substrate, an electrode between the front substrate and the rear substrate, and a seal layer between the front substrate and the rear substrate, wherein the first flexible circuit board is attached to a side surface of the rear substrate of the first panel, and the second flexible circuit board is attached to a side surface of the rear substrate of the second panel.

The first flexible circuit board may be electrically connected to a side surface of the electrode of the first panel, and the second flexible circuit board may be electrically connected to a side surface of the electrode of the second panel.

The first flexible circuit board may electrically connect to a driving board positioned in the rear of the first panel to the electrode of the first panel, and the second flexible circuit board may electrically connects to a driving board positioned in the rear of the second panel to the electrode of the second panel.

A first adhesive layer including conductive particles may be positioned between the first flexible circuit board and a side surface of the electrode of the first panel, and a second adhesive layer including conductive particles may be positioned between the second flexible circuit board and a side surface of the electrode of the second panel.

In another aspect, there is a plasma display device comprising a front substrate, a rear substrate opposite the front substrate, an electrode between the front substrate and the rear substrate, a seal layer between the front substrate and the rear substrate, a driving board positioned in the rear of the rear substrate, an auxiliary electrode electrically connected to the electrode, the auxiliary electrode including a portion on a side surface of the seal layer, a flexible circuit board electrically connecting the driving board to the auxiliary electrode, and an adhesive layer between the auxiliary electrode and the flexible circuit board, the adhesive layer including a plurality of conductive balls.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
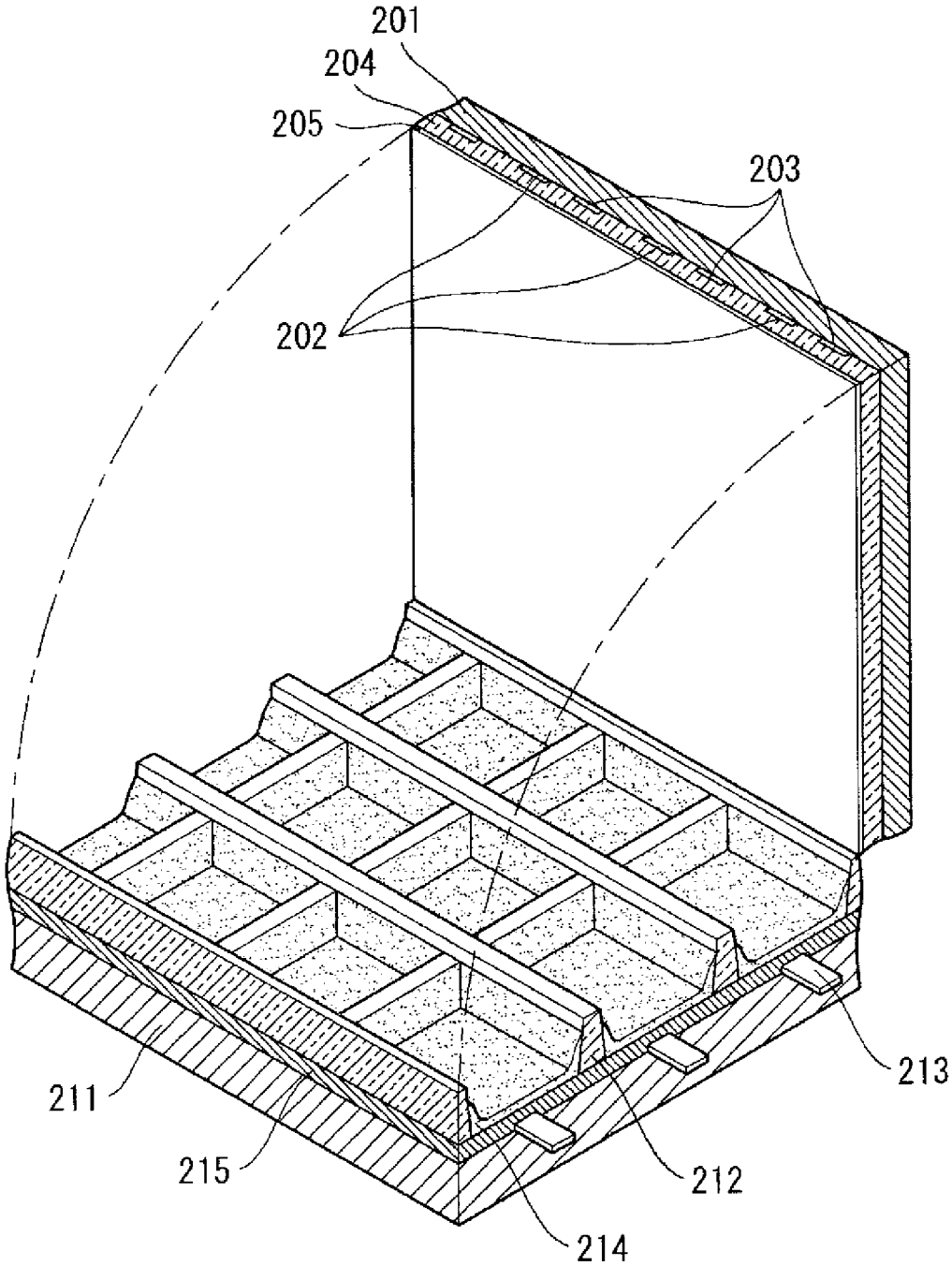
FIGS. 1 to 3 illustrate a structure and a driving method of a plasma display panel according to an embodiment of the invention.
Figure 2:
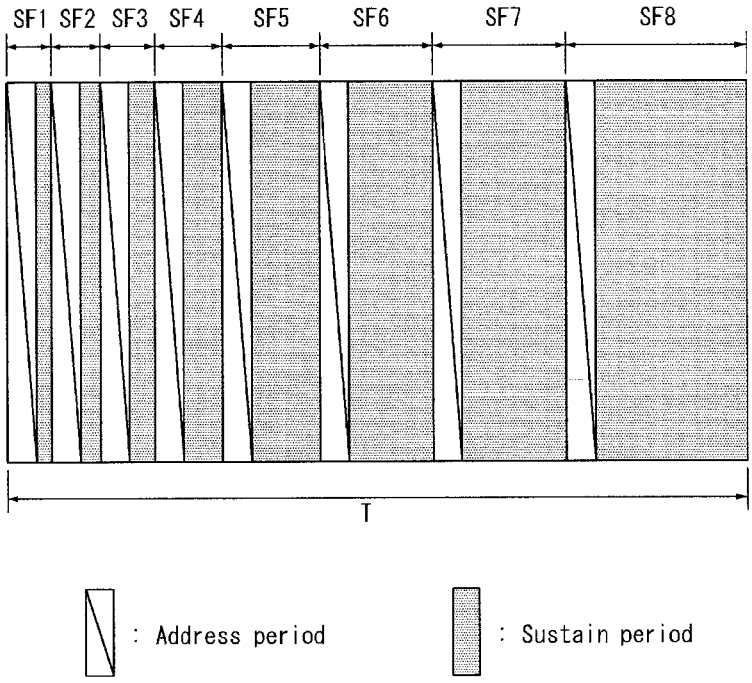
Figure 3:
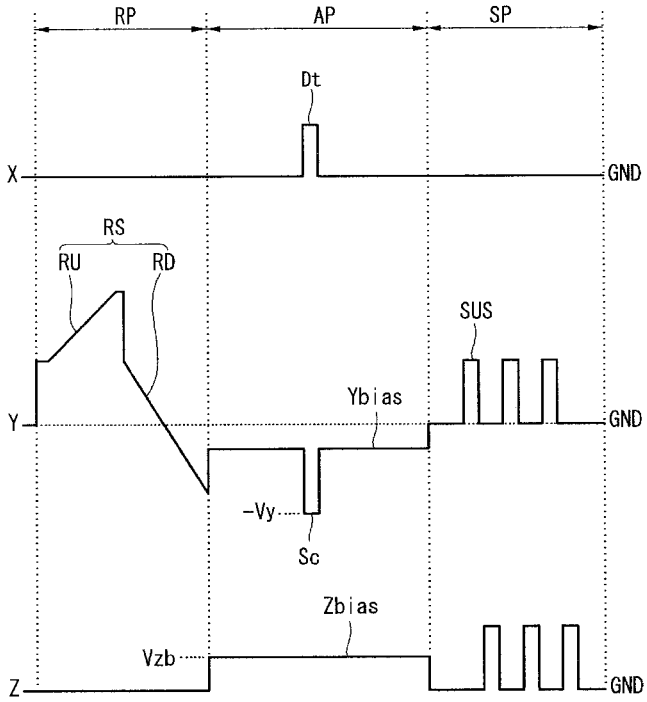

FIGS. 1 to 3 illustrate a structure and a driving method of a plasma display panel according to an embodiment of the invention.

A plasma display panel may display an image in a frame including a plurality of subfields.

More specifically, as shown in FIG. 1, the plasma display panel may include a front substrate 201, on which a plurality of first electrodes 202 and 203 are formed, and a rear substrate 211 on which a plurality of second electrodes 213 are formed to cross the first electrodes 202 and 203.

In FIGS. 1 to 3, the first electrodes 202 and 203 may include scan electrodes 202 and sustain electrodes 203 substantially parallel to each other, and the second electrodes 213 may be called address electrodes.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203.

A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to partition discharge spaces (i.e., discharge cells). Hence, a first discharge cell emitting red light, a second discharge cell emitting blue light, and a third discharge cell emitting green light, etc. may be formed between the front substrate 201 and the rear substrate 211. Each of the barrier ribs 212 may include first and second barrier ribs each having a different height.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells partitioned by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

A frame for achieving a gray scale of an image displayed on the plasma display panel is described with reference to FIG. 2.

As shown in FIG. 2, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 2, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^{\circ}$ and a gray level of a second subfield at $2^{1}$, the sustain period increases in a ratio of $2^{n}$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 2 shows that one frame includes 8 subfields, the number of subfields constituting a frame may vary. For example, a frame may include 10 or 12 subfields. Further, although FIG. 2 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

A driving waveform for driving the plasma display panel is illustrated in FIG. 3.

As shown in FIG. 3, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS may be alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

FIGS. 4 to 7 illustrate a configuration of a plasma display device according to an embodiment of the invention.

Figure 4:
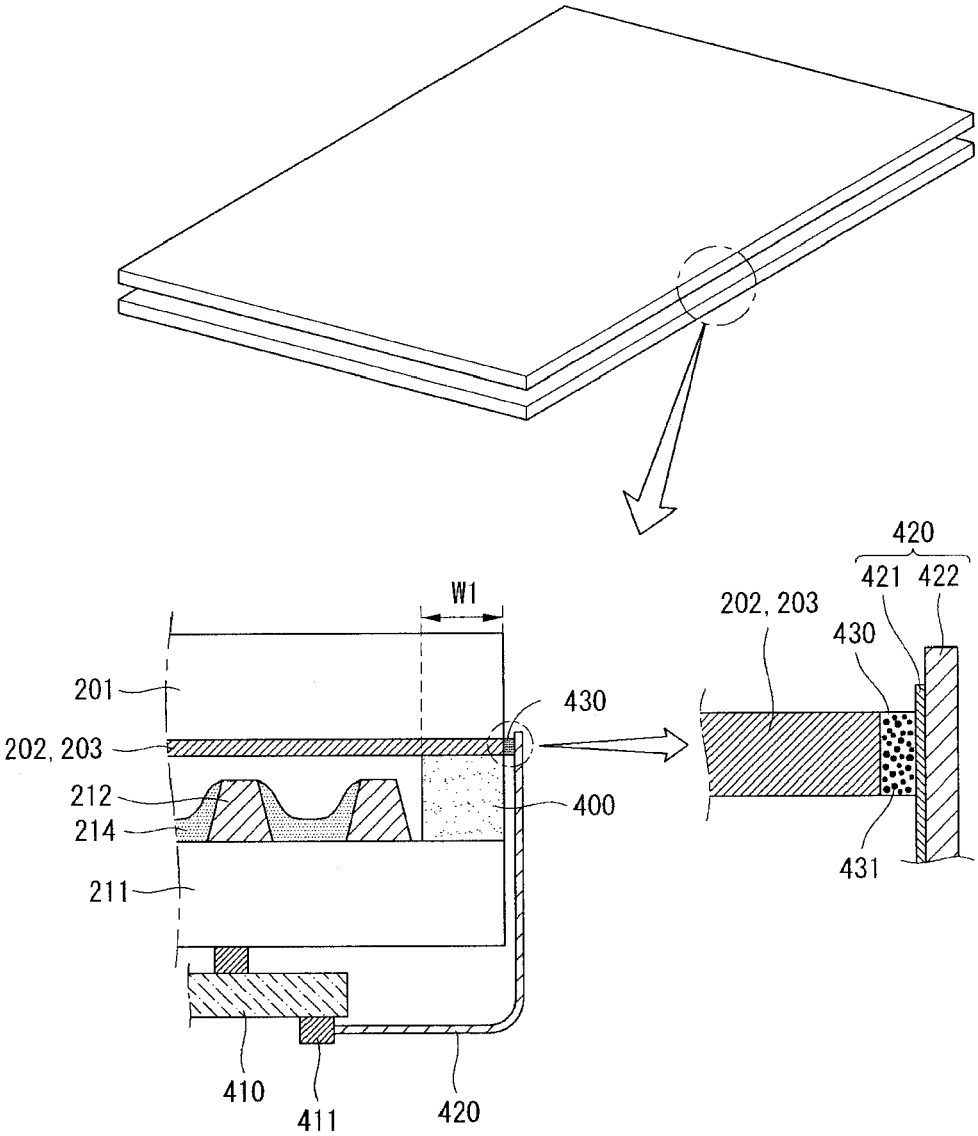
FIGS. 4 to 7 illustrate a configuration of a plasma display device according to an embodiment of the invention.

As shown in FIG. 4, a plasma display device according to an embodiment of the invention may include a plasma display panel, a driving board 410, and a flexible circuit board 420.

The plasma display panel, as described in FIG. 1, may include a front substrate 201, a rear substrate 211 positioned opposite the front substrate 201, electrodes 202 and 203 between the front substrate 201 and the rear substrate 211, and a seal layer 400 positioned between the front substrate 201 and the rear substrate 211 to attach the front substrate 201 to the rear substrate 211.

The driving board 410 may be positioned in the rear of the rear substrate 211 to supply driving signals to the electrodes 202 and 203 of the plasma display panel.

The flexible circuit board 420 may connect the driving board 410 to the electrodes 202 and 203. The flexible circuit board 420 has the flexibility capable of bending and may include a predetermined circuit pattern. Examples of the flexible circuit board 420 include a tape carrier package (TCP) and a flexible printed circuit (FPC).

One terminal of the flexible circuit board 420 may be connected to a connector 411 of the driving board 410, and the other terminal may be electrically connected to side surfaces of the electrodes 202 and 203. The flexible circuit board 420 may include a base 422 formed of resin or plastic and an electrode 421 on the base 422.

An adhesive layer 430 including a plurality of conductive particles 431 may be positioned between the flexible circuit board 420 and the side surfaces of the electrodes 202 and 203 to electrically connect the electrode 421 of the flexible circuit board 420 to the electrodes 202 and 203 of the plasma display panel using the conductive particles 431.

Lengths of the electrodes 202 and 203 may be reduced by electrically connecting the flexible circuit board 420 to the electrodes 202 and 203, and thus the size of a portion W1 of the plasma display panel on which an image is not displayed may be reduced. In other words, the size of a bezel of the plasma display panel on which an image is not displayed may be reduced.

Although the embodiment describes an example of using sheet type adhesive means, i.e., the adhesive layer 430, an adhesive including a plurality of conductive particles other than the sheet type adhesive means may be used in the embodiment. In the embodiment, the adhesive layer 430 has the properties of both the adhesive and the sheet type adhesive means.

Further, in FIG. 4, the electrodes 202 and 203 of the plasma display panel may indicate the scan electrode 202 and the sustain electrode 203 on the front substrate 201. However, the electrodes 202 and 203 of the plasma display panel may indicate the address electrode (not shown in FIG. 4) on the rear substrate 211. Hereinafter, the electrodes 202 and 203 of the plasma display panel indicate the scan electrode 202 and the sustain electrode 203 on the front substrate 201 for the convenience of explanation.

A method of manufacturing the plasma display device is described with reference to FIGS. 5 and 6.

Figure 5:
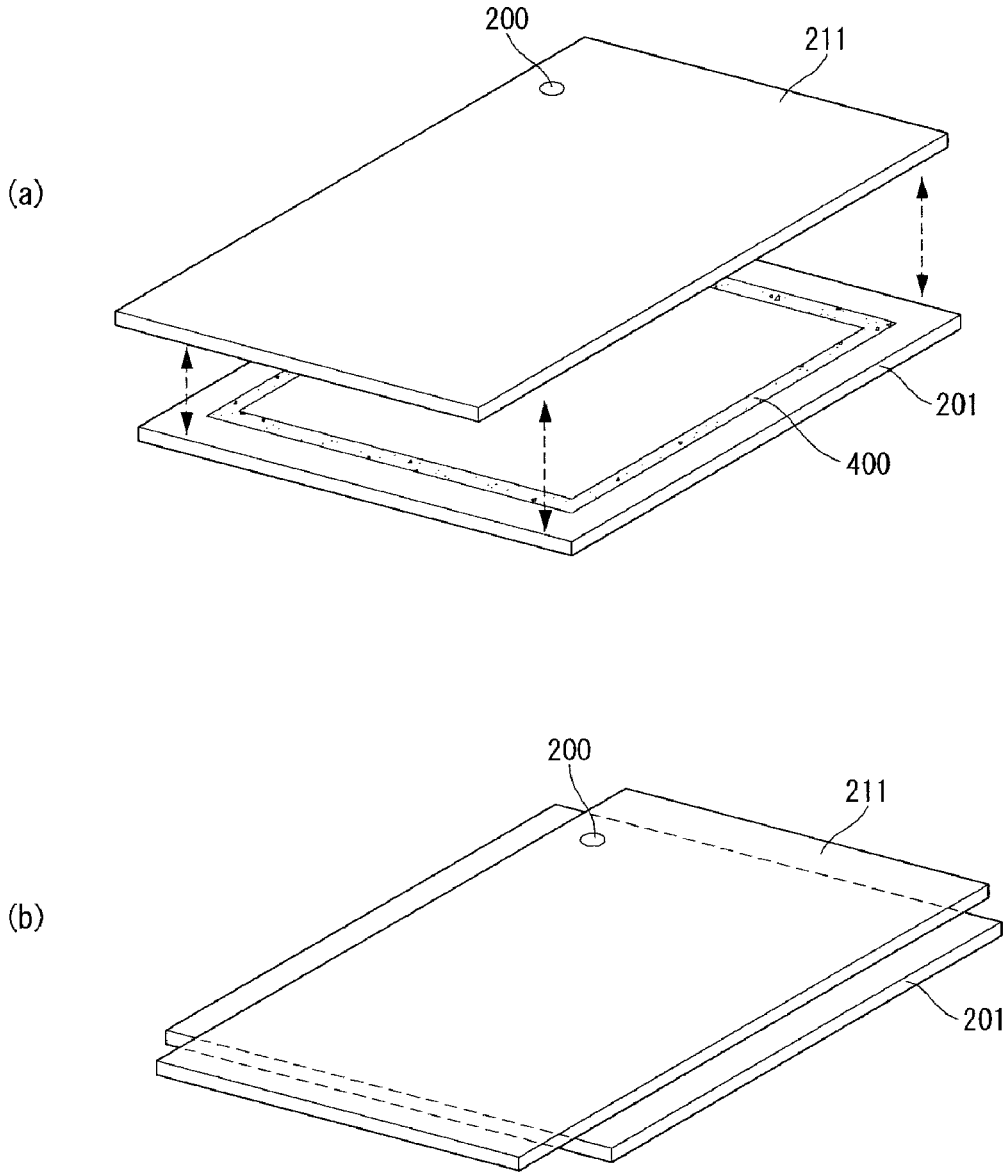

As shown in (a) of FIG. 5, the seal layer 400 may be formed at an edge of at least one of the front substrate 201 and the rear substrate 211 on which an exhaust hole 200 is formed. Thus, as shown in (b) of FIG. 5, the front substrate 201 and the rear substrate 211 may be attached to each other through the seal layer 400.

Subsequently, an exhaust tip (not shown) may be connected to the exhaust hole 200, and an exhaust pump (not shown) may be connected to the exhaust tip. The exhaust pump may exhaust an impurity gas remaining in a discharge space between the front substrate 201 and the rear substrate 211 to the outside and may inject a discharge gas, such as argon (Ar), neon (Ne), and xenon (Xe), into the discharge space. The discharge space between the front substrate 201 and the rear substrate 211 may be sealed through the above-described method.

Subsequently, as shown in (a) of FIG. 6, a portion of each of the front substrate 201 and the rear substrate 211 may be cut along a predetermined cutting line CL1 in a state where the front substrate 201 and the rear substrate 211 are attached to each other. A grinding process may be performed during a cutting process.

Figure 6:
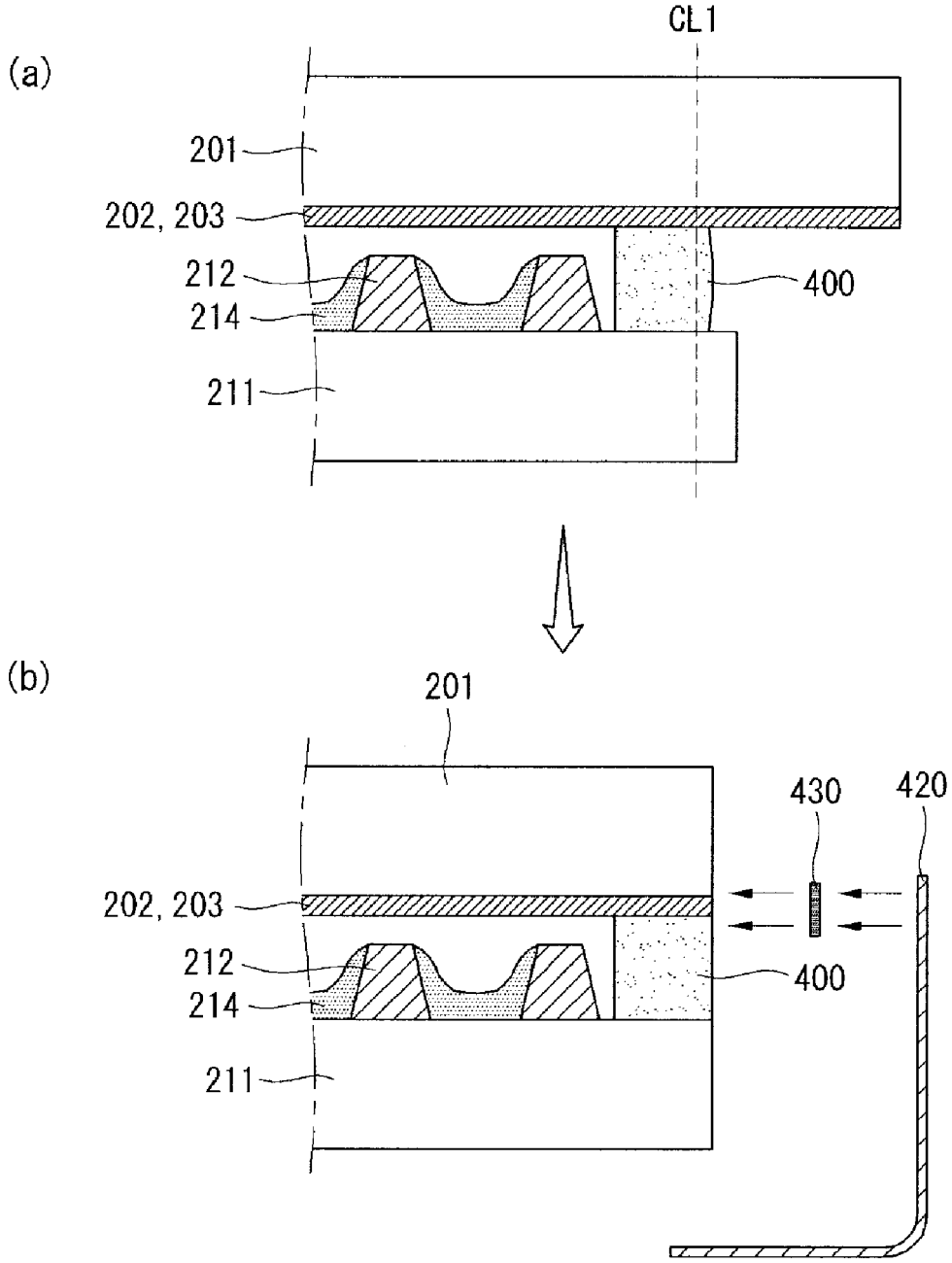

As a result, as shown in (b) of FIG. 6, at least one of the front substrate 201 and the rear substrate 211 may be prevented from excessively protruding in a cutting portion. Further, the size of a portion on which an image is not displayed may be reduced.

In the cutting process for cutting the portion of each of the front substrate 201 and the rear substrate 211 shown in (a) of FIG. 6, the seal layer 400 may be cut. If the seal layer 400 is cut, the size of the portion on which the image is not displayed may be greatly reduced.

Subsequently, as shown in (b) of FIG. 6, the adhesive layer 430 may be attached to the exposed side surfaces of the electrodes 202 and 203, and the flexible circuit board 420 may be attached to the adhesive layer 430.

Figure 7:
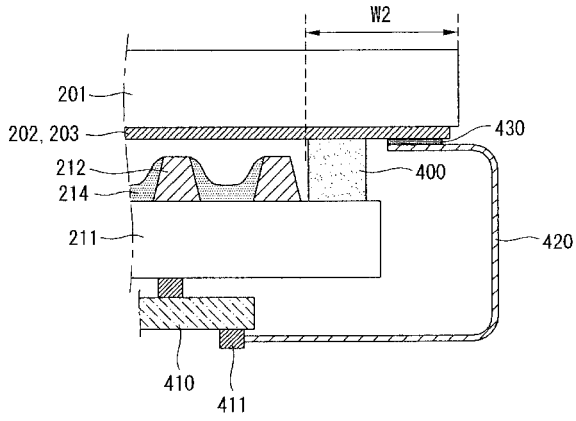

FIG. 7 illustrates a comparative example of the plasma display device according to the embodiment of the invention.

As shown in FIG. 7, in a plasma display device according to a comparative example, a front substrate 201 protrudes further than a rear substrate, and a portion of a front surface of each of electrodes 202 and 203 is exposed to the outside of a seal layer 400. An adhesive layer 430 is attached to a flexible circuit board 420 in the exposed portion of the front surface of each of the electrodes 202 and 203. In this case, the size of a portion W2 on which an image is not displayed may increase by exposing the portion of the front surface of each of the electrodes 202 and 203. Hence, the size of a bezel may increase.

On the other hand, in the plasma display device according to the embodiment of the invention shown in FIGS. 4 and 6, the size of the bezel may be further reduced compared with the comparative example by attaching the flexible circuit board 420 to the side surfaces of the electrodes 202 and 203.

FIGS. 8 to 15 illustrate a configuration of a plasma display device according to another embodiment of the invention. Structures and components identical or equivalent to those illustrated above are designated with the same reference numerals, and a further description may be briefly made or may be entirely omitted.

Figure 8:
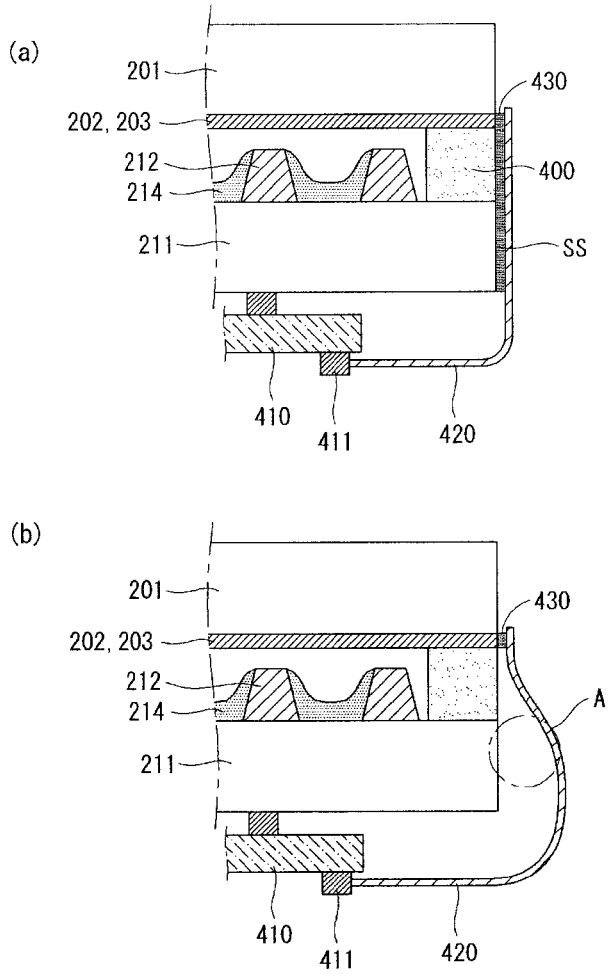
FIGS. 8 to 15 illustrate a configuration of a plasma display device according to another embodiment of the invention.

As shown in (a) of FIG. 8, a flexible circuit board 420 may be attached to a side surface SS of a rear substrate 211. For this, an adhesive layer 430 may be positioned between the flexible circuit board 420 and the side surface SS of the rear substrate 211.

When the flexible circuit board 420 is attached to the side surface SS of the rear substrate 211, a space occupied by the flexible circuit board 420 may be reduced. Hence, the size of a plasma display device may be further reduced, and the flexible circuit board 420 may be fastened to a plasma display panel. The adhesive layer 430 may be attached to the surface of a seal layer 400 so as to further fasten the flexible circuit board 420 to the plasma display panel. In this case, the flexible circuit board 420 may be attached to an overlapping portion between the flexible circuit board 420 and the seal layer 400 and an overlapping portion between the flexible circuit board 420 and the side surface SS of the rear substrate 211 by the adhesive layer 430.

For example, as shown in (b) of FIG. 8, if the flexible circuit board 420 is not attached to the rear substrate 211, a space between the flexible circuit board 420, the rear substrate 211, and the seal layer 400 may be provided. The space may cause an increase in the size of the plasma display device. Further, a bad electrical connection between electrodes 202 and 203 and the flexible circuit board 420 may be generated because of an impact applied to the plasma display device.

On the other hand, if the flexible circuit board 420 is attached to the side surface SS of the rear substrate 211 as shown in (a) of FIG. 8, the flexible circuit board 420 may be prevented from being damaged by the rear substrate 211.

Further, when the adhesive layer 430 is attached to the side surface SS of the rear substrate 211, a damage of the rear substrate 211 may be prevented.

Figure 9:
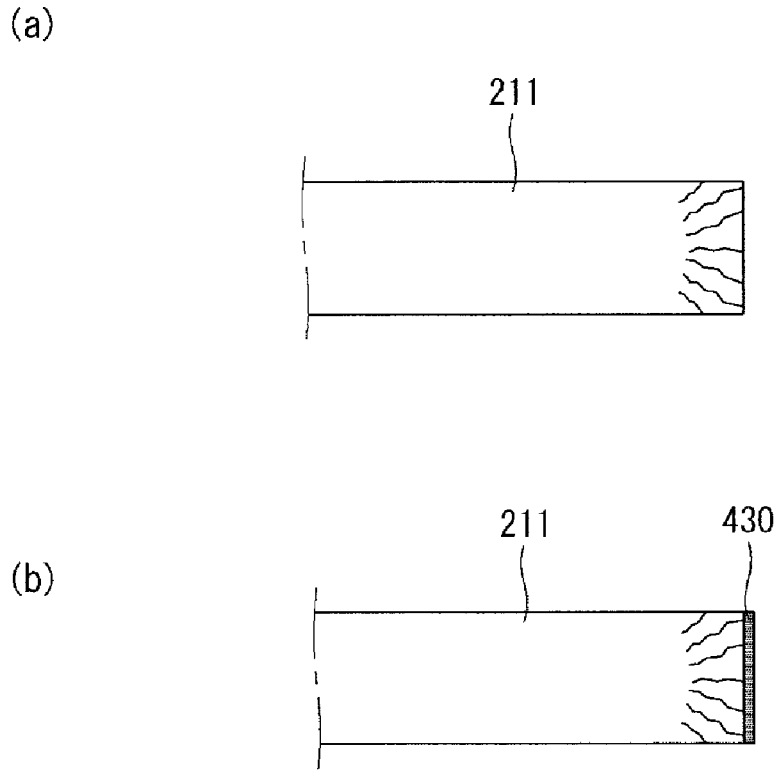

For example, as shown in (a) of FIG. 9, the rear substrate 211 may crack because of the physical properties of the rear substrate 211 formed of glass in a process for cutting a portion of the rear substrate 211 shown in (a) of FIG. 6. The cracks of the rear substrate 211 may reduce the structural reliability of the rear substrate 211.

On the other hand, as shown in (b) of FIG. 9, when the adhesive layer 430 is attached to the side surface SS of the rear substrate 211, the structural reliability of the rear substrate 211 may be improved even if cracks of the rear substrate 211 are generated as shown in (a) of FIG. 9.

Figure 10:
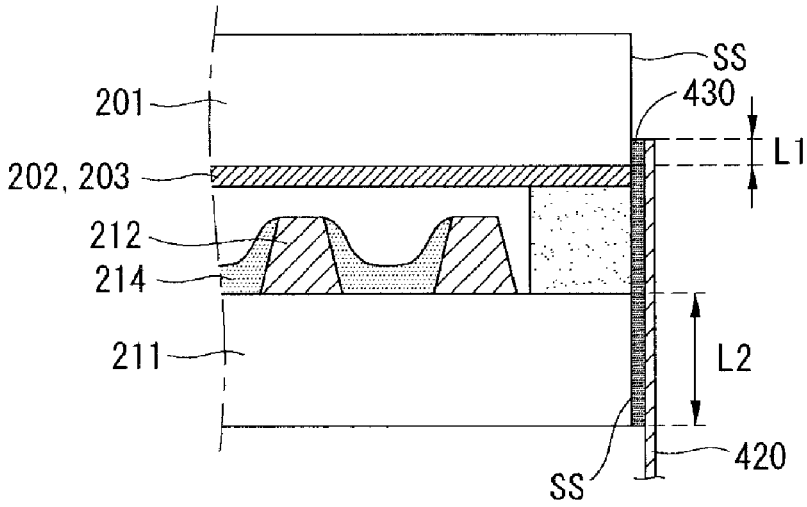

Alternatively, as shown in FIG. 10, the adhesive layer 430 may be attached to a portion of a side surface SS of a front substrate 201. Further, the flexible circuit board 420 may be attached to the seal layer 400, the side surface SS of the rear substrate 211, and the side surface SS of the front substrate 201 using the adhesive layer 430. In this case, an adhesive strength between the flexible circuit board 420 and the plasma display panel may be further improved.

A size of an overlapping portion L1 between the side surface SS of the front substrate 201 and the flexible circuit board 420 may be less than a size of an overlapping portion L2 between the side surface SS of the rear substrate 211 and the flexible circuit board 420. If the size of the portion L1 is equal to or greater than the size of the portion L2, the length of the flexible circuit board 420 may unnecessarily increase.

The flexible circuit board 420 may be electrically connected to the electrodes 202 and 203 to transfer driving signals supplied by a driving board 410 to the electrodes 202 and 203. Thus, the overlapping portion L1 between the side surface SS of the front substrate 201 and the flexible circuit board 420 may be a portion not contributing to the transfer of the driving signals.

Figure 11:
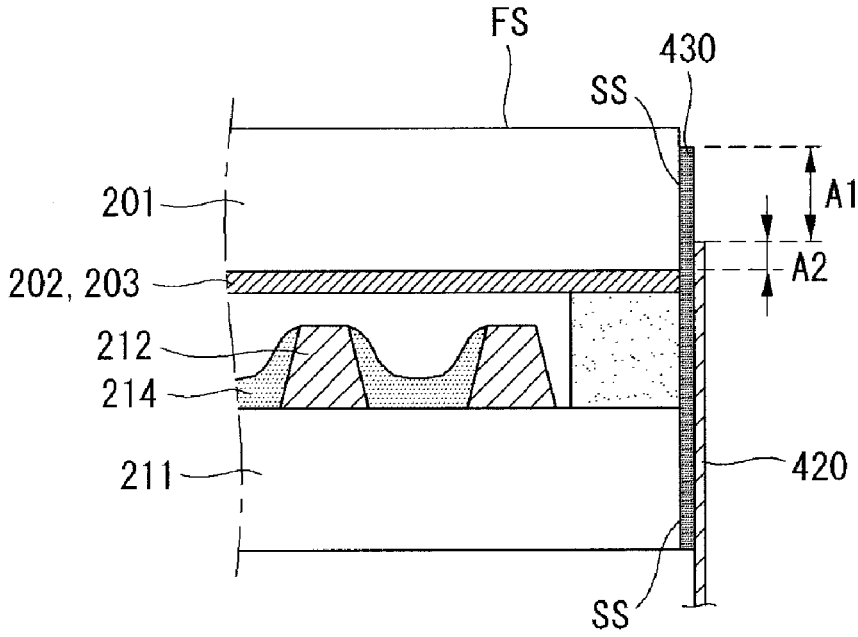

Alternatively, as shown in FIG. 11, the adhesive layer 430 may extend longer than the flexible circuit board 420 in a direction toward a front surface FS of the front substrate 201. In this case, even if cracks are generated in the front substrate 201, an excessive reduction in the structural reliability of the front substrate 201 may be prevented. Since this was described in detail in FIG. 9, a further description may be briefly made or may be entirely omitted.

In FIG. 11, the side surface SS of the front substrate 201 may include a first portion A1, in which not the flexible circuit board 420 but the adhesive layer 430 is positioned, and a second portion A2 in which both the adhesive layer 430 and the flexible circuit board 420 are positioned. In this case, a length of the first portion A1 may be greater than a length of the second portion A2 so as to prevent a length of the flexible circuit board 420 from unnecessarily increasing.

Figure 12:
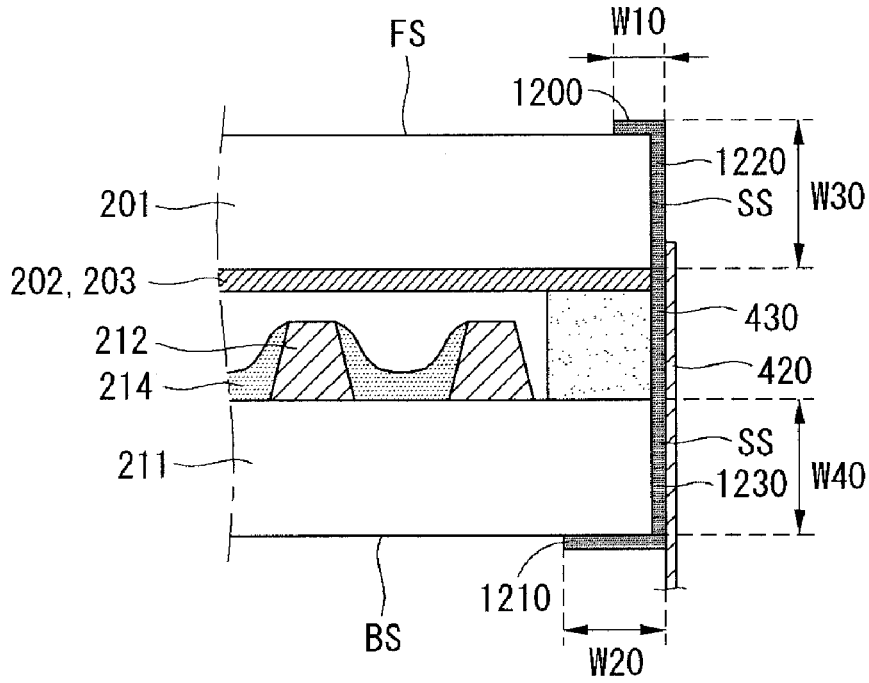

Alternatively, as shown in FIG. 12, the adhesive layer 430 may contact the front surface FS and the side surface SS of the front substrate 201 and the side surface SS and a back surface BS of the rear substrate 211. In this case, the structural reliability of the front substrate 201 and the rear substrate 211 may further improved by the adhesive layer 430.

Further, another component (for example, a structure (not shown) for grounding an EMI layer of a film filter positioned on the front surface FS of the front substrate 201) may be fastened to the plasma display panel using the adhesive layer 430.

In FIG. 12, the adhesive layer 430 may include a first portion 1200 contacting the front surface FS of the front substrate 201, a second portion 1210 contacting the back surface BS of the rear substrate 211, a third portion 1220 contacting the side surface SS of the front substrate 201, and a fourth portion 1230 contacting the side surface SS of the rear substrate 211.

If a width W10 of the first portion 1200 is excessively large, a portion on which an image is displayed may be covered by the adhesive layer 430. Thus, the width W10 of the first portion 1200 may be smaller than widths of the other portions. In other words, a width W20 of the second portion 1210 may be greater than the width W10 of the first portion 1200, and a width W30 of the third portion 1220 and a width W40 of the fourth portion 1230 may be greater than the width W10 of the first portion 1200.

Figure 13:
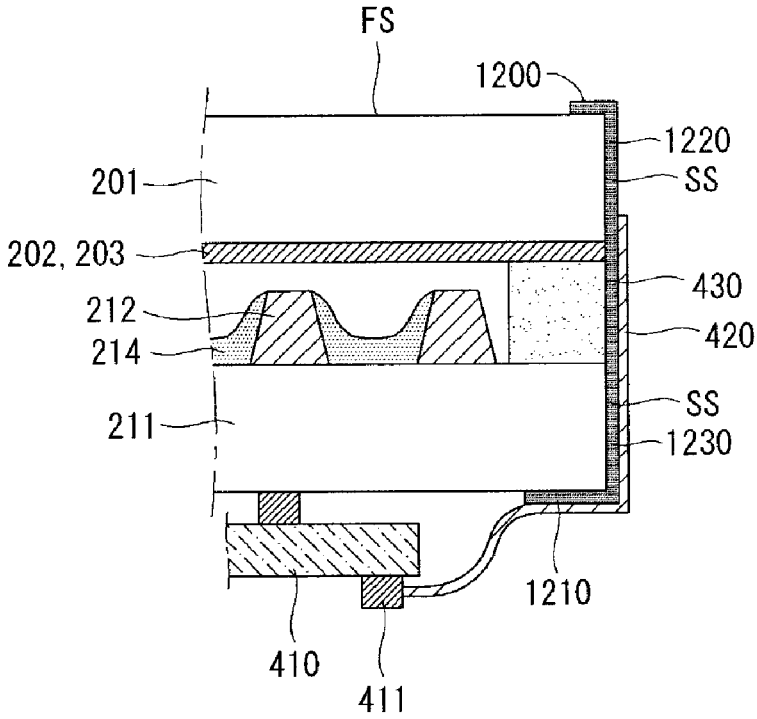

Alternatively, as shown in FIG. 13, the flexible circuit board 420 may be attached to the second portion 1210. In this case, the adhesive strength between the flexible circuit board 420 and the plasma display panel may be further improved.

The adhesive layer 430 of single sheet form is used in the embodiment, but the adhesive layer 430 that is divided into several portions may be used.

Figure 14:
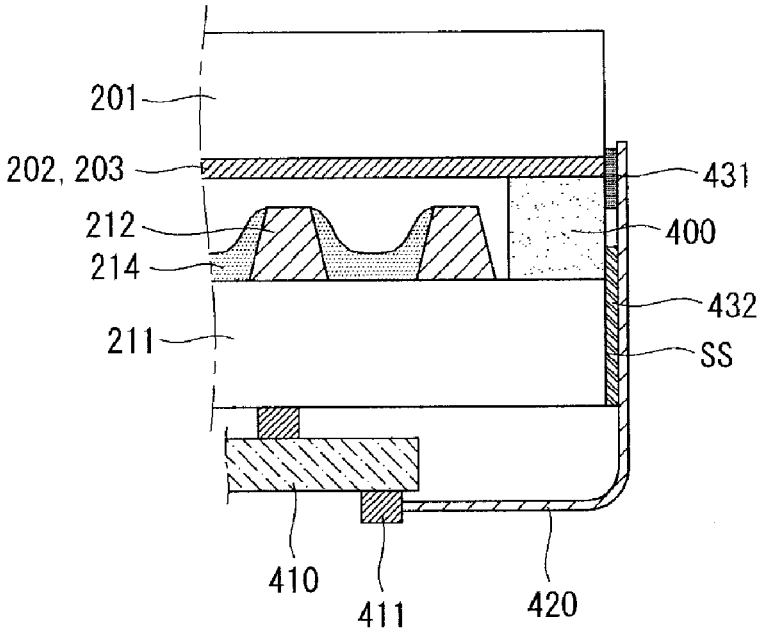

For example, as shown in FIG. 14, a first adhesive layer 431 may be positioned between the flexible circuit board 420 and the electrodes 202 and 203, and a second adhesive layer 432 may be positioned between the rear substrate 211 and the flexible circuit board 420.

The first adhesive layer 431 may include conductive particles and may electrically connect the electrodes 202 and 203 to the flexible circuit board 420. Because the second adhesive layer 432 does not electrically connect the electrodes 202 and 203 to the flexible circuit board 420, the second adhesive layer 432 may not include conductive particles. When the second adhesive layer 432 does not include the conductive particles, the manufacturing cost of the plasma display device may be reduced while improving the adhesive strength between the flexible circuit board 420 and the plasma display panel.

Figure 15:
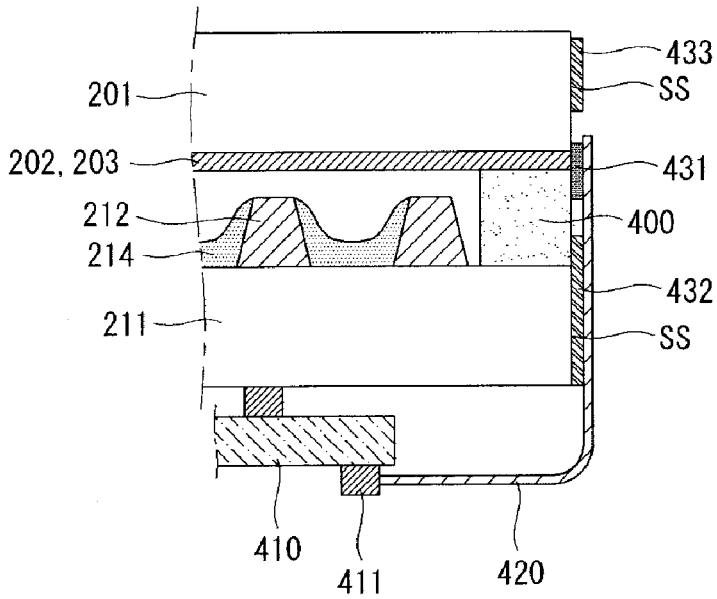

Alternatively, as shown in FIG. 15, a first adhesive layer 431 may be positioned between the flexible circuit board 420 and the electrodes 202 and 203, a second adhesive layer 432 may be positioned between the rear substrate 211 and the flexible circuit board 420, and a third adhesive layer 433 may be positioned on the side surface SS of the front substrate 201. The third adhesive layer 433 may not include conductive particles.

Figure 16:
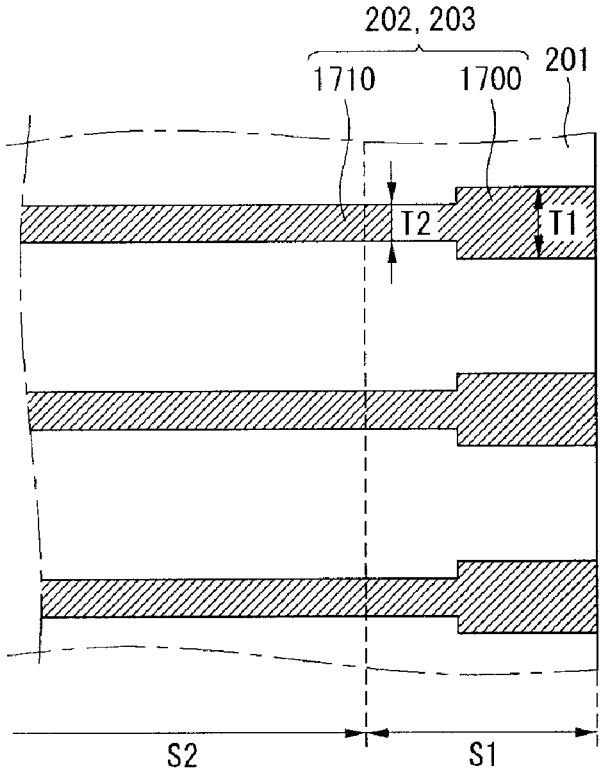
FIGS. 16 and 17 illustrate an electrode.
Figure 17:
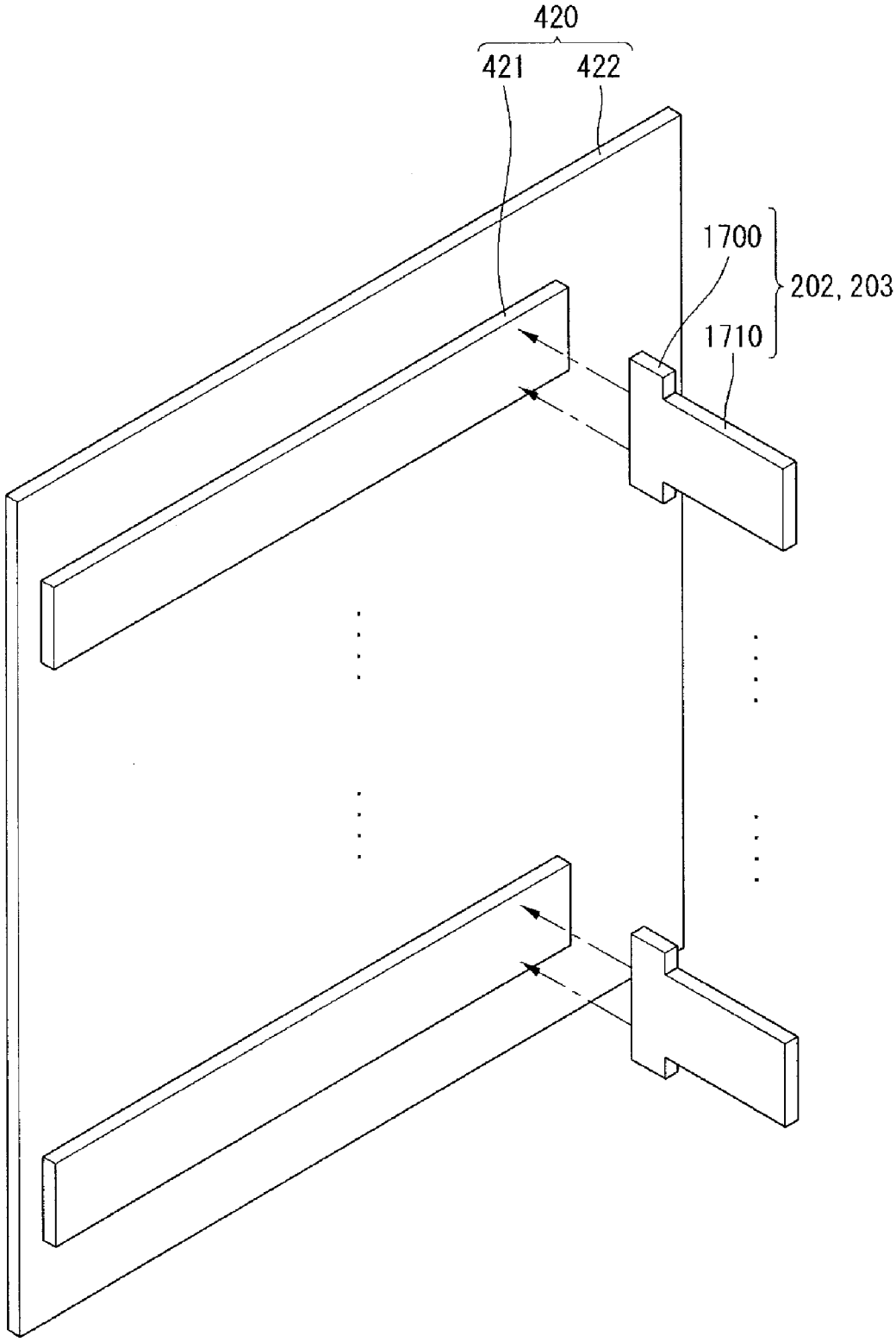

FIGS. 16 and 17 illustrate the electrodes 202 and 203.

As shown in FIG. 16, each of the electrodes 202 and 203 may include a first portion 1700 having a width T1 and a second portion 1710 having a width T2 smaller than the width T1.

The first portion 1700 is positioned in a first area S1. Although it is not shown, the first area S1 may be positioned in the seal layer. The second portion 1710 may be positioned in a second area S2, and the second area S2 may be an area on which the image is displayed (i.e., a formation area of the discharge cells). In other words, the width T1 of a portion overlapping the seal layer of each of the electrodes 202 and 203 may be greater than the width T2 in the formation area of the discharge cells.

As above, when the width T1 of the first portion 1700 is greater than the width T2 of the second portion 1710 in each of the electrodes 202 and 203, as shown in FIG. 17, the size of a contact portion between the electrodes 202 and 203 and an electrode 421 of the flexible circuit board 420 with the adhesive layer (not shown in FIG. 17) interposed between the electrodes 202 and 203 and the electrode 421 may increase. Hence, a contact resistance between the flexible circuit board 420 and the electrodes 202 and 203 may be reduced.

FIGS. 18 to 21 illustrate an auxiliary electrode. Structures and components identical or equivalent to those illustrated above are designated with the same reference numerals, and a further description may be briefly made or may be entirely omitted.

Figure 18:
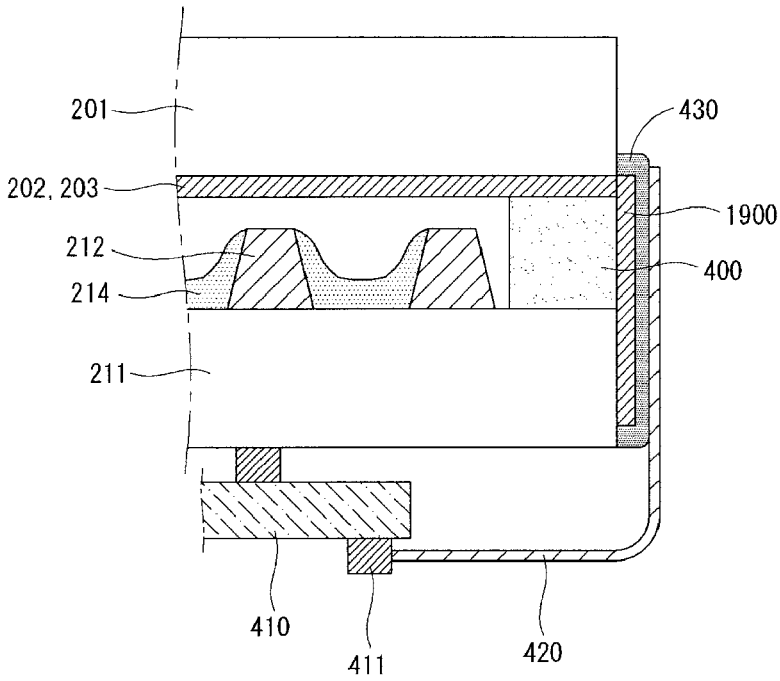
FIGS. 18 to 21 illustrate an auxiliary electrode.

As shown in FIG. 18, an auxiliary electrode 1900 may be positioned on side surfaces of electrodes 202 and 203. The auxiliary electrode 1900 may be electrically connected to the electrodes 202 and 203 and may include a portion on a side surface of a seal layer 400.

After a portion of each of a front substrate 201 and a rear substrate 211 is cut along a predetermined cutting line CL1 as shown in (a) of FIG. 6, the auxiliary electrode 1900 may be formed on a cut surface. In this case, a flexible circuit board 420 may electrically connect the auxiliary electrode 1900 to a driving board 410. For this, an adhesive layer 430 including a plurality of conductive balls may be positioned between the auxiliary electrode 1900 and the flexible circuit board 420.

As above, in the plasma display device according to the embodiment, a possibility of a bad electrical connection between the electrodes 202 and 203 and the flexible circuit board 420 may decrease by forming the auxiliary electrode 1900 electrically connected to the electrodes 202 and 203 at the side of a plasma display panel and attaching the flexible circuit board 420 to the auxiliary electrode 1900.

Further, the auxiliary electrode 1900 may include a portion on a side surface of the rear substrate 211 while including the portion on the side surface of the seal layer 400.

Figure 19:
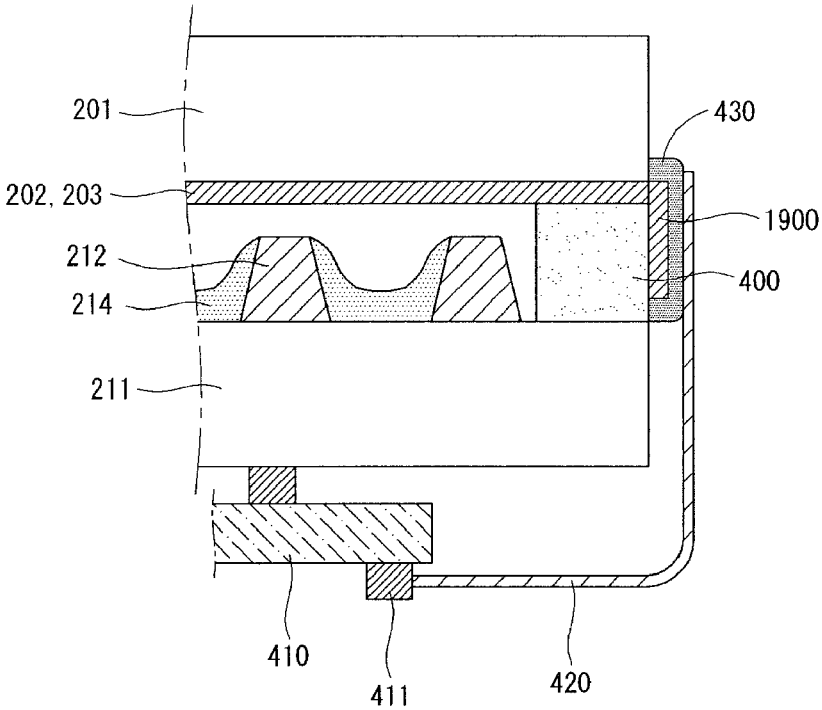

Alternatively, as shown in FIG. 19, the auxiliary electrode 1900 may not include a portion on the side surface of the rear substrate 211.

Figure 20:
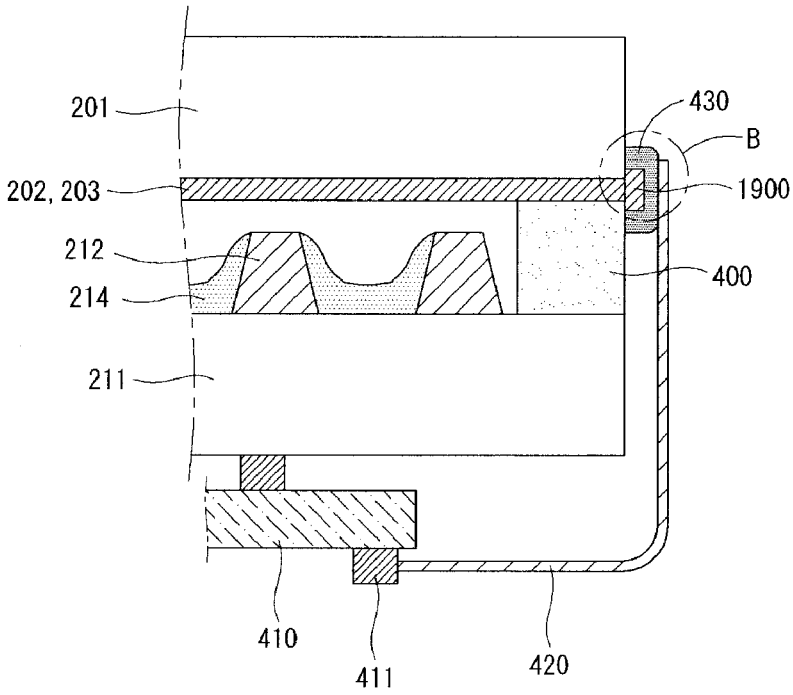

Alternatively, as shown in FIG. 20, the auxiliary electrode 1900 may include a portion B on a side surface of the front substrate 201.

Figure 21:
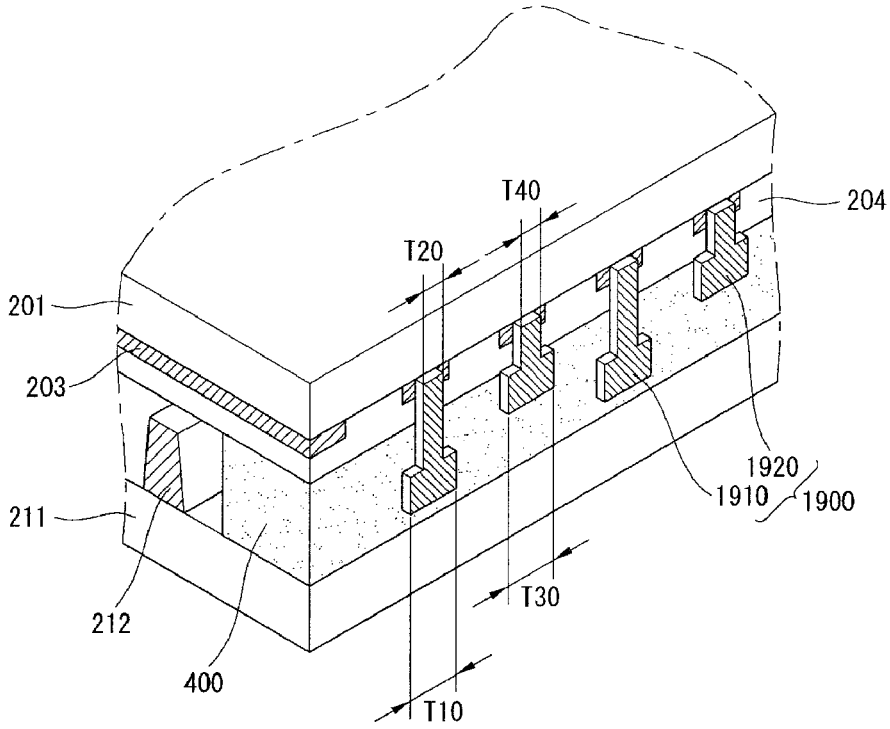

Alternatively, as shown in FIG. 21, the auxiliary electrode 1900 may include a first auxiliary electrode 1910 and a second auxiliary electrode 1920 each having a different length. Each of the first auxiliary electrode 1910 and the second auxiliary electrode 1920 may include a portion, and widths of the portions of the first and second auxiliary electrodes 1910 and 1920 are different from each other.

More specifically, the first auxiliary electrode 1910 may include a first portion having a width T10 and a second portion having a width T20 smaller than the width T10, and the second auxiliary electrode 1920 may include a first portion having a width T30 and a second portion having a width T40 smaller than the width T30.

The first portion of the first auxiliary electrode 1910 and the first portion of the second auxiliary electrode 1920 may be positioned to cross each other. Hence, a contact area between the first and second auxiliary electrodes 1910 and 1920 and the flexible circuit board 420 may increase while electrical short-circuit between the adjacent first and second auxiliary electrodes 1910 and 1920 is prevented. As a result, an electrical resistance may be reduced.

Figure 22:
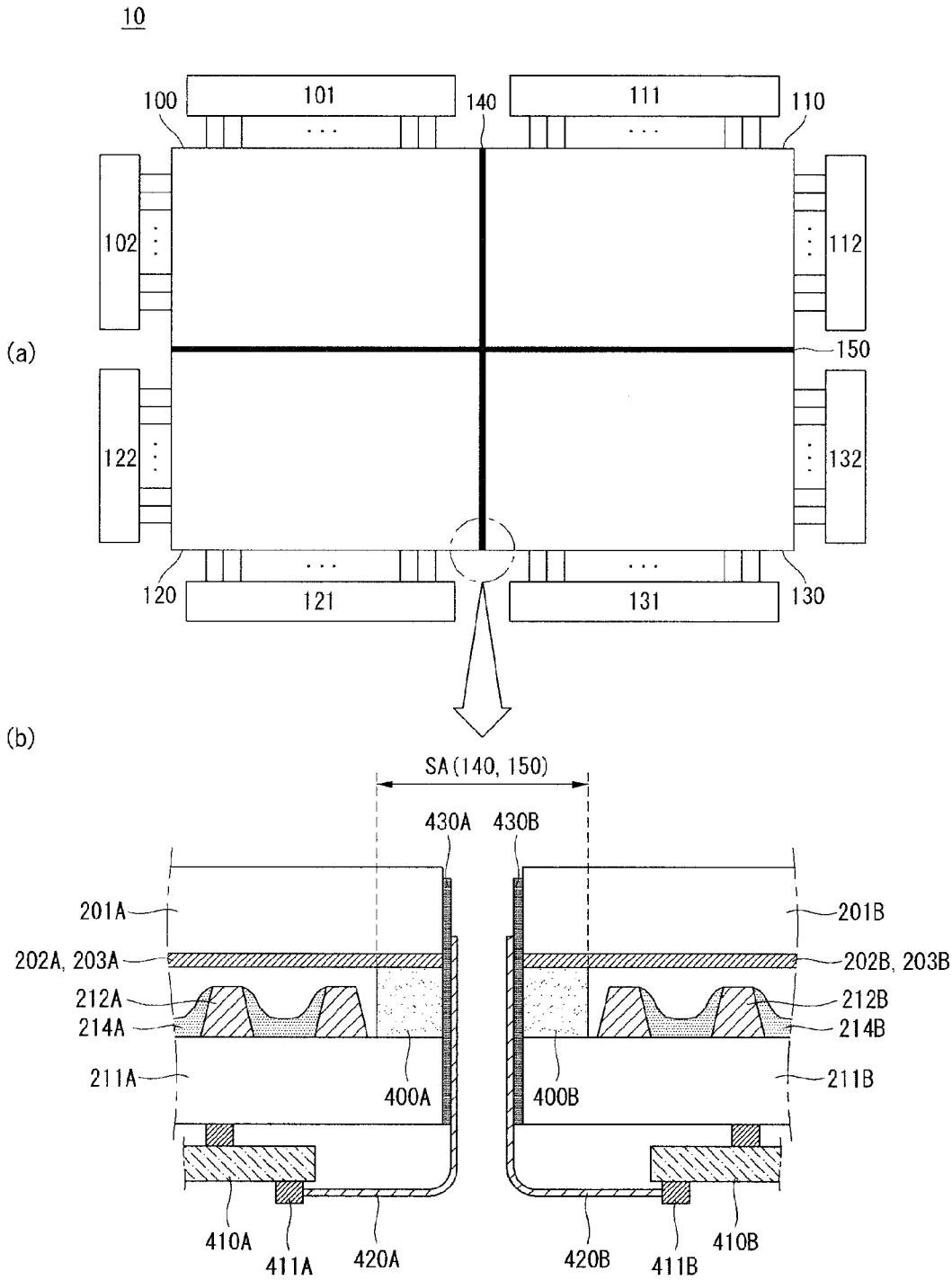
FIG. 22 illustrates a multi plasma display device according to an embodiment of the invention.

FIG. 22 illustrates a multi plasma display device according to an embodiment of the invention. All of characteristics of the plasma display device illustrated in FIGS. 1 to 21 may be applied to the multi plasma display device shown in FIG. 22. Thus, structures and components identical or equivalent to those illustrated above are designated with the same reference numerals, and a further description may be briefly made or may be entirely omitted.

As shown in (a) of FIG. 22, a multi plasma display device 10 according to an embodiment of the invention may include a plurality of plasma display panels 100, 110, 120, and 130 positioned adjacent to one another.

Among the plurality of plasma display panels 100, 110, 120, and 130, a 1-1 driver 101 and a 1-2 driver 102 may supply driving signals to the first plasma display panel 100. The 1-1 driver 101 and the 1-2 driver 102 may be integrated into one driver. Further, a 2-1 driver 111 and a 2-2 driver 112 supply driving signals to the second plasma display panel 110. In other words, the plasma display panels 100, 110, 120, and 130 may be structured so that a different driver supplies a driving signal to each of the plasma display panels 100, 110, 120, and 130.

Seam portions 140 and 150 are formed between two adjacent plasma display panels of the plurality of plasma display panels 100, 110, 120, and 130. The seam portions 140 and 150 may be called regions between the two adjacent plasma display panels.

In the multi plasma display device 10, because an image is displayed on the plurality of plasma display panels 100, 110, 120, and 130 positioned adjacent to one another, the seam portions 140 and 150 may be formed between two adjacent plasma display panels.

As shown in (b) of FIG. 22, first and second flexible circuit boards 420A and 420B may be positioned in a boundary portion between two adjacent plasma display panels, for example, in the boundary portion 140 between the first and second plasma display panels 100 and 110. The first flexible circuit board 420A may be attached to a side surface of a rear substrate 211A of the first plasma display panel 100, and the second flexible circuit board 420B may be attached to a side surface of a rear substrate 211B of the second plasma display panel 110.

The first flexible circuit board 420A may be electrically connected to side surfaces of electrodes 202A and 203A of the first plasma display panel 100, and the second flexible circuit board 420B may be electrically connected to side surfaces of electrodes 202B and 203B of the second plasma display panel 110. Further, the first flexible circuit board 420A may electrically connect a driving board 410A positioned in the rear of the first plasma display panel 100 to the electrodes 202A and 203A, and the second flexible circuit board 420B may electrically connect a driving board 410B positioned in the rear of the second plasma display panel 110 to the electrodes 202B and 203B.

A first adhesive layer 430A including conductive particles may be positioned between the first flexible circuit board 420A and the side surfaces of the electrodes 202A and 203A, and a second adhesive layer 430B including conductive particles may be positioned between the second flexible circuit board 420B and the side surfaces of the electrodes 202B and 203B. The first adhesive layer 430A may commonly contact a front substrate 201A, the rear substrate 211A, and a seal layer 400A of the first plasma display panel 100, and the second adhesive layer 430B may commonly contact a front substrate 201B, the rear substrate 211B, and a seal layer 400B of the second plasma display panel 110.

In the multi plasma display device according to the embodiment of the invention, because the size of a portion on which an image is not displayed is reduced by attaching the flexible circuit board to the side surface of the rear substrate of each of the plurality of plasma display panels and electrically connecting the flexible circuit board to the side surfaces of the electrodes, the size of the first and second seam portions may be reduced. Hence, the image may be smoothly displayed on the adjacent plasma display panels. Thus, the quality of the image displayed by the multi plasma display device may be improved.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display device comprising:

a front substrate;

a rear substrate opposite the front substrate;

a first electrode disposed on the front substrate, the first electrode including at least one of a scan electrode or a sustain electrode;

a second electrode disposed on the rear substrate;

a barrier rib, for partitioning a discharge cell, disposed between the front substrate and the rear substrate;

a seal layer between the front substrate and the rear substrate;

a driving board positioned in the rear of the rear substrate;

a flexible circuit board electrically connecting the driving board to the first electrode, the flexible circuit board being electrically connected to a side surface of the first electrode; and an adhesive layer positioned between the flexible circuit board and the side surface of the first electrode, the adhesive layer including conductive particles.

2. The plasma display device of claim 1, wherein the adhesive layer contacts the front substrate, the rear substrate, and the seal layer.

3. A plasma display device comprising:

a front substrate;

a rear substrate opposite the front substrate;

a first electrode disposed on the front substrate, the first electrode including at least one of a scan electrode or a sustain electrode;

a second electrode disposed on the rear substrate;

a barrier rib, for partitioning a discharge cell, disposed between the front substrate and the rear substrate;

a seal layer between the front substrate and the rear substrate;

a driving board positioned in the rear of the rear substrate; and a flexible circuit board electrically connecting the driving board to the first electrode, the flexible circuit board being electrically connected to a side surface of the rear substrate.

4. A plasma display device comprising:

a front substrate;

a rear substrate opposite the front substrate;

a first electrode disposed on the front substrate, the first electrode including at least one of a scan electrode or a sustain electrode;

a second electrode disposed on the rear substrate;

a barrier rib, for partitioning a discharge cell, disposed between the front substrate and the rear substrate;

a seal layer between the front substrate and the rear substrate;

a driving board positioned in the rear of the rear substrate; and a flexible circuit board electrically connecting the driving board to the first electrode, wherein the flexible circuit board is attached to an adhesive layer, so that the flexible circuit board overlaps the front substrate, the rear substrate, and the seal layer using the adhesive layer, wherein the adhesive layer includes conductive particles.

5. The plasma display device of claim 4, wherein a size of an overlapping portion between a side surface of the front substrate and the flexible circuit board is less than a size of an overlapping portion between a side surface of the rear substrate and the flexible circuit board.

6. The plasma display device of claim 4, wherein a side surface of the front substrate includes a first portion, in which the adhesive layer and the flexible circuit board are positioned, and a second portion, in which the adhesive layer is positioned and the flexible circuit board is not positioned, and wherein a size of the first portion is greater than a size of the second portion.

7. The plasma display device of claim 4, wherein the flexible circuit board is electrically connected to a side surface of the first electrode.

8. A plasma display device comprising:

a front substrate;

a rear substrate opposite the front substrate;

a first electrode disposed on the front substrate, the first electrode including at least one of a scan electrode or a sustain electrode;

a second electrode disposed on the rear substrate;

a barrier rib, for partitioning a discharge cell, disposed between the front substrate and the rear substrate;

a seal layer between the front substrate and the rear substrate;

a driving board positioned in the rear of the rear substrate;

a flexible circuit board electrically connecting the driving board to the first electrode; and an adhesive layer electrically connecting the first electrode to the flexible circuit board, the adhesive layer contacting a front surface and a side surface of the front substrate and a side surface and a back surface of the rear substrate.

9. The plasma display device of claim 8, wherein the adhesive layer contacts the seal layer.

10. The plasma display device of claim 8, wherein the adhesive layer includes conductive particles.

11. The plasma display device of claim 8, wherein the adhesive layer includes a first portion contacting the front surface of the front substrate, a second portion contacting the back surface of the rear substrate, a third portion contacting the side surface of the front substrate, and a fourth portion contacting the side surface of the rear substrate, and wherein a width of the second portion is greater than a width of the first portion.

12. The plasma display device of claim 11, wherein a width of the third portion and a width of the fourth portion are greater than the width of the first portion.

13. The plasma display device of claim 11, wherein the flexible circuit board is attached to the second portion and is not attached to the first portion.

14. A multi plasma display device comprising:

a first panel;

a second panel positioned adjacent to the first panel; and first and second flexible circuit boards positioned in a boundary portion between the first panel and the second panel, wherein the first panel includes a front substrate, a rear substrate opposite the front substrate, a first electrode including at least one of a scan electrode or a sustain electrode disposed on the front substrate, a seal layer between the front substrate and the rear substrate, a second electrode disposed on the rear substrate, and a barrier rib, for partitioning a discharge cell, disposed between the front substrate and the rear substrate, wherein the second panel includes a front substrate, a rear substrate opposite the front substrate, a first electrode including at least one of a scan electrode or a sustain electrode disposed on the front substrate, a seal layer between the front substrate and the rear substrate, a second electrode disposed on the rear substrate, and a barrier rib, for partitioning a discharge cell, disposed between the front substrate and the rear substrate, and wherein the first flexible circuit board is attached to a side surface of the rear substrate of the first panel, and the second flexible circuit board is attached to a side surface of the rear substrate of the second panel.

15. The multi plasma display device of claim 14, wherein the first flexible circuit board is electrically connected to a side surface of the first electrode of the first panel, and wherein the second flexible circuit board is electrically connected to a side surface of the first electrode of the second panel.

16. The multi plasma display device of claim 14, wherein the first flexible circuit board electrically connects to a driving board positioned in the rear of the first panel to the first electrode of the first panel, and wherein the second flexible circuit board electrically connects to a driving board positioned in the rear of the second panel to the first electrode of the second panel.

17. The multi plasma display device of claim 14, wherein a first adhesive layer including conductive particles is positioned between the first flexible circuit board and a side surface of the first electrode of the first panel, and wherein a second adhesive layer including conductive particles is positioned between the second flexible circuit board and a side surface of the first electrode of the second panel.

18. A plasma display device comprising:

a front substrate;

a rear substrate opposite the front substrate;

a first electrode disposed on the front substrate, the first electrode including at least one of a scan electrode or a sustain electrode;

a second electrode disposed on the rear substrate;

a barrier rib, for partitioning a discharge cell, disposed between the front substrate and the rear substrate;

a seal layer between the front substrate and the rear substrate;

a driving board positioned in the rear of the rear substrate;

an auxiliary electrode electrically connected to the first electrode, the auxiliary electrode including a portion on a side surface of the seal layer;

a flexible circuit board electrically connecting the driving board to the auxiliary electrode; and an adhesive layer between the auxiliary electrode and the flexible circuit board, the adhesive layer including a plurality of conductive balls.

* * * * *